US006579652B1

(12) United States Patent
Detig et al.

(10) Patent No.: US 6,579,652 B1
(45) Date of Patent: Jun. 17, 2003

(54) DURABLE ELECTROSTATIC PRINTING PLATE AND METHOD OF MAKING THE SAME

(75) Inventors: Robert H. Detig, New Providence, NJ (US); Dietmar C. Eberlein, Wappingers Falls, NY (US)

(73) Assignee: Electrox Corporation, Denville, NJ (US)

( * ) Notice: Subject to any disclaimer, the term of this patent is extended or adjusted under 35 U.S.C. 154(b) by 0 days.

(21) Appl. No.: 09/718,702

(22) Filed: Nov. 22, 2000

Related U.S. Application Data

(60) Provisional application No. 60/167,133, filed on Nov. 23, 1999.

(51) Int. Cl.[7] ..... G03G 13/26

(52) U.S. Cl. ..... 430/49; 427/145; 427/199; 427/283; 430/126

(58) Field of Search ..... 430/49, 126, 52; 427/199, 145, 283

(56) References Cited

U.S. PATENT DOCUMENTS 4,732,831 A 3/1988 Riesenfeld et al.
5,011,758 A 4/1991 Detig et al.
5,147,826 A 9/1992 Liu et al.
5,275,851 A 1/1994 Fonash et al.
6,171,740 B1 1/2001 Fonash et al.

FOREIGN PATENT DOCUMENTS

JP 61275847 A * 12/1986 ..... 430/49

OTHER PUBLICATIONS

Applied Physics Letters vol. 75, No. 5, "Defined crystallization on amorphous–silicon films using contact printing", pp. 595–597, to Bae et al.(Jan. 31, 2000).*

Derwent Acc No. 1987–018042 (1987).*

* cited by examiner

*Primary Examiner*—Christopher Rodee
(74) *Attorney, Agent, or Firm*—Kenyon & Kenyon

(57) ABSTRACT

The present invention relates to the fabrication of a durable electrostatic printing plate. The electrostatic printing plate includes a substrate with an image receiving layer applied thereto. The image receiving layer includes a permanent pattern defined by an amorphous region and a polycrystalline region.

7 Claims, 1 Drawing Sheet

DURABLE ELECTROSTATIC PRINTING PLATE AND METHOD OF MAKING THE SAME

RELATED U.S. APPLICATION DATA

This application claims the benefit of U.S. Provisional Application 60/167,133, filed Nov. 23, 1999.

FIELD OF THE INVENTION

The present invention relates to a durable electrostatic printing plate including a substrate coated with an image receiving layer and, more particularly, to such a printing plate wherein the image receiving layer includes both amorphous and polycrystalline regions. The invention also relates to a method of making such a printing plate.

BACKGROUND OF THE INVENTION

Electrostatic printing, sometimes referred to as Xeroprinting, typically utilizes an electrostatic printing plate or roll including a grounded conductive substrate with a permanent (persistent or fixed) image or pattern of insulating material formed thereon. A common method of forming the permanent image or pattern on the surface of the conductive substrate is to deposit a photosensitive polymer layer, also referred to as a photopolymer layer, on the surface of the conductive substrate, such as disclosed in U.S. Pat. No. 4,732,831 to Riesenfeld, et al. Such layer is typically 5 to 50$\mu$ thick. The photopolymer is exposed to actinic radiation in a desired image or pattern causing the photopolymer to selectively increase its resistivity, producing a persistent image on the electrostatic printing plate. Thereafter, the electrostatic printing plate is charged using corona discharge, causing the latent, high resistivity, insulating areas to build a static charge, while areas of low resistance discharge comparatively quickly. The image is developed for transfer to another surface by toning with oppositely charged particles of toner, in liquid or dry form. The toner is then transferred by electrostatic or other means to another surface such as paper, polymeric film or phenolic resin. Since the original image is fixed in the photopolymer layer, multiple copies can be made with a single exposure of the photopolymer by merely repeating the corona charging, toning and transfer steps.

A mask or photo-tool may be utilized to expose the electrostatic printing plate to light. When the photopolymer layer of the printing plate is exposed to actinic radiation through the mask or photo-tool, the polymeric molecules of the photopolymer become cross-linked in the pattern exposed and an image or pattern is developed in the photopolymer. When the electrostatic printing plate is charged with a corona unit, of the type known in the art, the cross-linked regions of photopolymer retain a high level of electrostatic charge, but the unexposed, uncross-linked regions quickly dissipate the charge. Alternatively, a photopolymer may be selected that reduces cross-linking when exposed to actinic radiation, which likewise produces a persistent image or pattern of contrasting high-resistivity and low-resistivity regions on the surface of the electrostatic printing plate.

A problem with existing electrostatic printing plates is that while the substrate component of each of the plates may be comprised of a durable metal material, the photopolymeric coating is comparatively soft and is subject to damage, thereby negatively effecting the useful life of the plate. In recognition of the foregoing, a method of protecting the photopolymeric coating was developed. Such method is disclosed in U.S. Pat. No. 5,011,758 to Detig. This method involves protecting the photopolymeric layer with a polymeric film. However, the disclosed, protective polymeric film also has a limited useful life, especially when abrasive toner materials are utilized such as glass, metal or inorganic powders like oxides and sulfides.

Photoreceptor plates are frequently used for the transfer of toner images to a receiving surface. Amorphous silicon photoreceptor plates are one of the commercially useful types of photoreceptor plates utilized in standard, toner-based copy machines and laser printers. Photoreceptor plates of amorphous selenium, amorphous selenium alloys of arsenic and tellurium, and organic photo conductor (OPC) plates are also commercially used. These amorphous materials have a much longer useful life than the photopolymer layer or the protective polymer films, providing for millions of copies from a single photoreceptor plate. A typical amorphous photoreceptor plate is 25 to 50 micrometers thick on a rigid aluminum plate or drum. The amorphous structure of such photoreceptor plates allows electrostatic charge to be retained for useful periods of time (as little as a few seconds). However, if the material of the plates crystallizes, the inter-crystalline grain boundaries create regions of high electrical conductivity resulting in the immediate discharging of the plate. This phenomenon has been exemplified in early amorphous selenium plates that were subjected to unexpected crystallization caused by thermal cycling and trace metal contamination in the air. This catalytic crystallization caused these selenium plates to fail since they were unable to store electrostatic charge for sufficient periods of time. The literature teaches away from exposing receptor plates to trace elements that could lead to catalytic crystallization of the amorphous layer of the receptor plate.

However, in a non-analogous field, fabrication of polycrystalline silicon thin film transistors, an amorphous film of silicon was selectively crystallized in areas directly in contact with a toner containing trace impurities. U.S. Pat. No. 5,275,851 to Fonash et al. describes a process that selectively changes the state of an amorphous silicon thin film from amorphous to polycrystalline by depositing trace quantities of palladium in a desired image or pattern in contact with the amorphous silicon thin film. In such process, the silicon layer is heated to a temperature of approximately about 600° C., which nucleates the catalytic crystallization of the amorphous silicon in contact with the palladium, but does not nucleate the remaining amorphous silicon layer. The heating of the silicon layer selectively crystallizes the initially, completely amorphous layer of silicon thereby creating a desired image or pattern for polycrystalline thin film transistors. See, also, U.S. Pat. No. 5,147,826 to Liu et al., which describes converting amorphous silicon to polycrystalline silicon using annealing temperatures in the range from about 550° C. to 650° C. after depositing nucleating sites on the surface of the amorphous silicon film.

SUMMARY OF THE INVENTION

It is an object of the present invention to selectively crystallize a film of an amorphous material, creating a persistent image or pattern on an electrostatic printing plate, which can be used to electrostatically transfer a high-quality and high-contrast image to a receiving surface with less wear and a longer life than existing photopolymer coated electrostatic printing plates.

There is provided an electrostatic printing plate comprising a rigid or flexible substrate coated with an image receiving layer that includes an amorphous region and a polycrystalline region. The image receiving layer is preferably comprised of silicon, selenium or their alloys. The invention also relates to a durable electrostatic printing plate or drum that is fabricated using a process that causes an amorphous, insulating layer to selectively crystallize in a desired pattern, which can then be used to repeatedly transfer dry or liquid toner to a receiving surface.

In one preferred embodiment, an electrostatic plate includes a metal substrate with a silicon layer deposited thereon. A palladium-containing toner is subsequently deposited on the amorphous silicon layer in a desired image. Then, when the amorphous silicone layer is heated to an adequate temperature, the palladium nucleates the catalytic crystallization of the amorphous silicon causing a polycrystalline pattern to develop in the amorphous silicon. The amorphous and polycrystalline silicon layer is highly durable and resistant to wear from subsequent use with abrasive toner particles, allowing millions of images to be transferred from a single electrostatic plate or drum.

Alternatively, the palladium-containing toner could be selectively applied to the metal substrate, and the amorphous silicon layer could subsequently be deposited. In addition, a mask could be used to selectively deposit trace quantities of palladium on the surface of either the substrate or the amorphous silicon layer.

While the time that is allowed for the nucleation of the amorphous silicon may depend on many factors, including, for example, the heating temperature, the type of amorphous, insulating layer, the type of trace impurity used to nucleate catalytic crystallization and concentration of the trace impurity, one of ordinary skill in the art would be able to determine the time necessary for nucleation using a few simple benchmark experiments known in the art.

As a representative embodiment of the present invention, an amorphous silicon film coated with a palladium-containing toner caused nucleation of polycrystalline grains when heated to a temperature of about 550 to about 600 degrees centigrade for 5 to 10 minutes. The polycrystalline nature of the silicon film was verified by the thin films inability to hold an electrostatic charge for more than a few seconds.

The present invention is further directed to a method of fabricating the durable electrostatic printing plate.

Further objects and advantages of the present invention will be apparent to those skilled in the art from the detailed description of the disclosed invention.

DETAILED DESCRIPTION OF THE INVENTION

Figure 1:
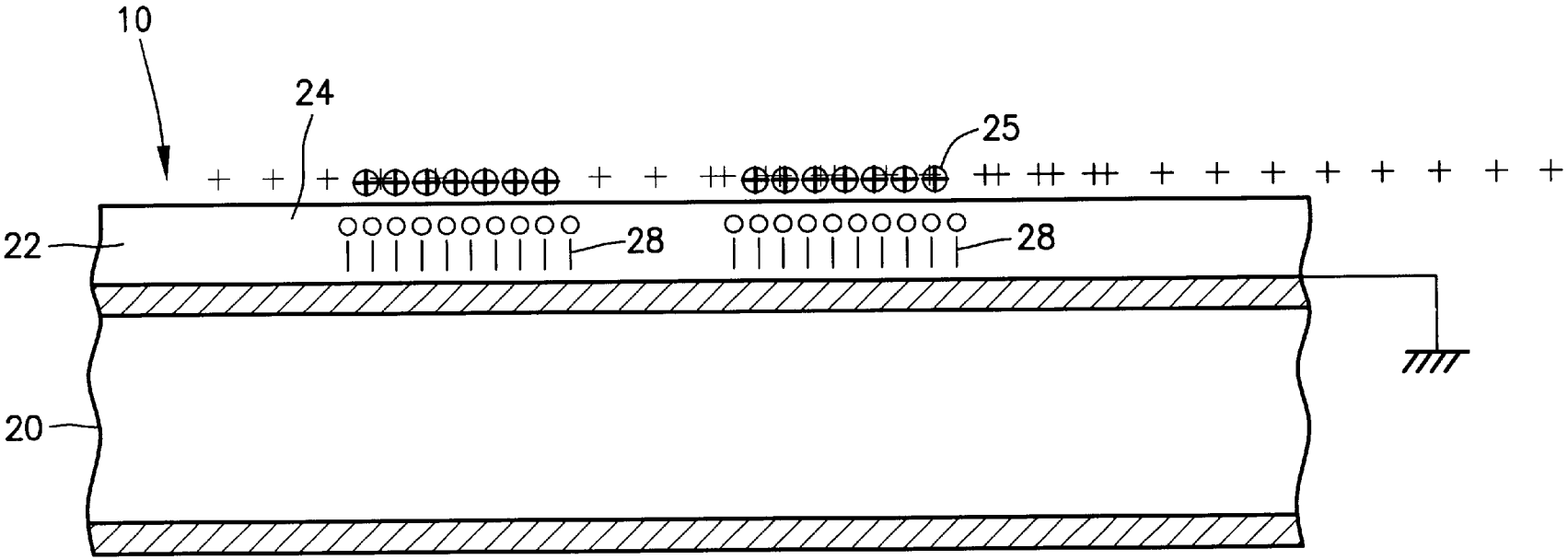
FIG. 1 is a cross-sectional view of an electrostatic printing plate of the present invention.

The present invention will be described with reference to the illustrative embodiments in the following description. These embodiments are intended only as illustrative examples and the invention is not to be limited thereto.

The present invention relates to a durable electrostatic printing plate or drum that is fabricated using a process that causes an amorphous, insulating layer to selectively crystallize in a desired pattern, which can then be used to repeatedly transfer dry or liquid toner to a receiving surface.

The following describes certain specific representative embodiments in accordance with the present invention, the materials, apparatus and process steps being understood as examples that are intended to be illustrative only. In particular, the invention is not intended to be limited to the methods, materials, conditions, process parameters, apparatus and the like specifically recited herein.

The present invention, as shown in FIG. 1, is directed to a durable, electrostatic plate 10 comprising a conductive substrate 20 and an image receiving layer 22 having a permanent pattern defined by an amorphous region and a polycrystalline region. The substrate is preferably from about 1 to about 10 millimeters thick and the image receiving layer is preferably about 10 to about 50 microns thick. The image receiving layer 22 preferably includes both an amorphous region 24 and a polycrystalline region 28 with the polycrystalline region selectively crystallized by annealing an initially amorphous layer that is contacted with a nucleant containing toner 25 to form a desired permanent pattern in the polycrystalline region 28.

In one preferred method of fabricating an electrostatic printing plate of the present invention, a durable electrostatic printing plate 10 including a metallic substrate (aluminum) 20 was coated initially with an initially amorphous silicon layer 22. The amorphous silicon, having a high resistivity, was selectively crystallized using a palladium-containing toner 25 (palladium concentration 12%) by first selectively depositing the palladium-containing toner in a desired pattern and then heating the printing plate. FIG. 1. Any temperature adequate to initiate the selective nucleation process without generally nucleating crystallization of the amorphous silicon can be used in this process. A preferred temperature of greater than about 500° C. and, more preferably, from about 550° C. to about 600° C. was used to effectively heat the printing plate and achieve adequate nucleation of a crystalline region in the amorphous silicon layer in about 1 to 10 minutes.

The grain boundaries of the polycrystalline silicon dissipate electrostatic charges after charging of the electrostatic printing plate, but the pattern of electrostatic charges is retained in the polycrystalline silicon regions. Therefore, the electrostatic plate may be used as a permanent master for producing high-quality and high-contrast images by repeatedly charging the electrostatic printing plate with a corona unit, waiting until the polycrystalline areas dissipate the static charge, developing the latent electrostatic image by applying toner, and transferring the toner to a receiving surface.

In another embodiment of fabricating a durable, electrostatic printing plate, the amorphous silicon layer was heated to about 500° C. for about a minute, and the areas with palladium-containing toner (palladium concentration 12%) fixed to the initially uniformly amorphous silicon layer caused the amorphous silicon to become polycrystalline silicon in the areas directly contacting the palladium-containing toner.

In one specific embodiment of the present invention, a silicon drum from a Fujitsu F6774 E/F, 50 page per minute printer with a 108 mm diameter and 370 mm long was used to fabricate a permanent master electrostatic printing plate. The amorphous silicon surface of the drum was crystallized by first transferring liquid palladium catalyst toner, Electrox product number EPT 1-b from an electrostatic printing plate to the drum by means of an electric field; drying the liquid palladium catalyst toner and associated Isopar dilutant; placing the treated drum in a preheated furnace for rapid thermal annealing by heating the treated drum to between about 550° C. and about 600° C. for about 5 to 10 minutes;

and removing the treated drum from the furnace. Subsequent observation of the drum showed polycrystalline regions in all of the areas coated with the liquid palladium catalyst toner.

The drum was subsequently used to produce high-quality and high-contrast images on paper by merely charging the drum with a corona unit between about 600 volts to about 800 volts; waiting about one second for the polycrystalline areas to dissipate charge; applying toner to the drum; transferring the toner retained by the electrostatically charged amorphous silicon areas to the surface of the paper by contact transfer; and fusing the toner to the paper.

While the present invention has been illustrated herein for a metal substrate with a silicon film or coating, it is to be understood that other amorphous, image receiving films could be substituted for silicon and other trace particles substituted for the palladium nucleant, and this would remain within the scope of this invention. For example, selenium, selenium/tellurium alloys, arsenic tri-selenide could be used for the amorphous, insulating film. Also, by way of example, nucleating particles could include tin, mercury, platinum, nickel, silver and gold.

In addition, one skilled in the art will recognize that any amorphous layer with a comparatively high resistivity compared to the resistivity of its polycrystalline state could be utilized as the image receiving layer, so long as a suitable trace impurity is known to nucleate crystallization at a temperature less than the temperature that would cause general re-crystallization of the amorphous layer. For example, selenium may be used instead of silicon or alloys of selenium or silicon may be used.

Also included within the scope of the present invention are durable, electrostatic printing plates that include a substrate including an insulating layer (e.g., glass, alumina or quartz) coated with a conductive layer (e.g, chrome, aluminum, or ITO). In such embodiment, the image receiving layer is applied to the conductive layer and the polycrystalline and amorphous regions are formed thereon.

As used herein, the term permanent pattern refers to a pattern or image that persists for the useful life of the electrostatic printing plate. However, one skilled in the art would understand that a permanent pattern could be capable of being altered, erased or reconditioned by treating the surface chemically, thermally or both. The permanence of the image merely refers to the ability of the layer to persist for repeated transfer of images to a receiving surface without re-treatment or re-exposure of the surface.

What is claimed is:

1. A method of fabricating a durable electrostatic printing plate comprising the steps of:

providing a conductive substrate;

applying an initially amorphous, image receiving layer to the conductive substrate; and forming a polycrystalline region in the image receiving layer;

wherein the step of forming a polycrystalline region includes the steps of:

applying a toner with a nucleating agent to the amorphous, image receiving layer, and annealing the electrostatic printing plate to enable the nucleating agent in the toner to selectively crystallize regions in the image receiving layer and form a permanent pattern thereon.

2. The method of claim 1 wherein the substrate is comprised of a metal.

3. The method of claim 1 wherein the image receiving layer is a material selected from the group consisting of silicon, selenium, and alloys of selenium.

4. The method of claim 1 wherein the nucleating agent is selected from the group consisting of palladium, tin, mercury, platinum, nickel, silver and gold.

5. The method of claim 1 wherein the step of annealing comprises heating the electrostatic printing plate to a temperature of greater than about 500° C. for about 1 to about 10 minutes.

6. The method of claim 1 wherein the step of annealing comprises heating the electrostatic printing plate to a temperature of about 550° C. to about 600° C. for about 5 to about 10 minutes.

7. The method of claim 1 wherein the conductive substrate comprises an insulating layer coated with a conductive layer, and wherein the initially amorphous, image receiving layer is applied to the conductive layer of the conductive substrate.

* * * * *